US008089327B2

(12) United States Patent
Margomenos et al.

(10) Patent No.: US 8,089,327 B2
(45) Date of Patent: Jan. 3, 2012

(54) WAVEGUIDE TO PLURAL MICROSTRIP TRANSITION

(75) Inventors: Alexandros Margomenos, Ann Arbor, MI (US); Paul D. Schmalenberg, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 251 days.

(21) Appl. No.: 12/400,027

(22) Filed: Mar. 9, 2009

(65) Prior Publication Data

US 2010/0225410 A1 Sep. 9, 2010

(51) Int. Cl.
*H01P 5/107* (2006.01)

(52) U.S. Cl. ..... 333/26; 333/128; 333/21 A

(58) Field of Classification Search ..... 333/26, 333/128, 136, 21 A
See application file for complete search history.

(56) References Cited

U.S. PATENT DOCUMENTS

| | | | | |
|---|---|---|---|---|
| 5,276,410 | A * | 1/1994 | Fukuzawa et al. | 333/21 A |
| 5,528,074 | A * | 6/1996 | Goto et al. | 257/664 |
| 6,580,335 | B1 * | 6/2003 | Iizuka et al. | 333/26 |
| 6,794,950 | B2 | 9/2004 | du Toit et al. | |
| 6,967,543 | B2 * | 11/2005 | Ammar | 333/26 |
| 7,446,710 | B2 | 11/2008 | Wu et al. | |

OTHER PUBLICATIONS

K. Sakakibara et al., Design and Optimization of MM-Wave Microstrip-to-Waveguide Transition Operation Over Broad Frequency Bandwidth, IEICE Transactions on Electronics, vol. E90-C, No. Jan. 1, 2007.

M. Davidovitz, Wideband Waveguide-to Micropstrip Transition and Power divider, IEEE Microwave and Guided Wave Letter, vol. 6, No. 1, Jan. 1996.

Y. Huang et al., An Integrated LTCC Laminated Waveguide to Microstrip Line T-junction, IEEE Microwave and Wireless Components Letters, vol. 13, No. 8, Aug. 2003.

T. Kai et al., A Cost Effective Transition Between a Microstrip Line and a Post-Wall Waveguide Using a Laminated LTCC Substrate in the 60 GHz band, IEICE Transactions on Electronics, vol. E90-C, No. 4, Apr. 2007.

W. Menzel et al., Microstrip to Waveguide Transition Compatible with MM-Wave Integrated Circuits. IEEE Transactions on Microwave Theory and Techniques, vol. 42, No. 9, Sep. 1994.

K. Sakakibara et al., MM-Wave Transition from Waveguide to Microstrip Lines Using Rectangular Patch Elements, IEEE Transactions on Microwave Theory and Techniques, vol. 55, No. 5, May 2007.

* cited by examiner

*Primary Examiner* — Benny Lee
(74) *Attorney, Agent, or Firm* — Gifford, Krass, Sprinkle, Anderson & Citkowski, P.C.

(57) ABSTRACT

A waveguide to microstrip transition having a waveguide open at one end. A dielectric substrate includes a first and a second side and a ground plane covers the first side of the substrate. The dielectric substrate overlies the waveguide opening so that the ground plane faces the waveguide and an opening in the ground plane registers with the waveguide opening. A back short having a housing is positioned on the second side of the dielectric substrate. The back short housing forms a cavity which registers with at least a portion of the ground plane opening so that microwave energy from the waveguide passes through the dielectric substrate and into the cavity defined by the back short housing. The back short housing has at least one opening to the cavity along the second side of the dielectric substrate. A pair of spaced apart microstrips on the second side of the substrate each have a free end positioned in the cavity so that the free ends of the microstrips are spaced apart from each other.

9 Claims, 3 Drawing Sheets

Fig-1
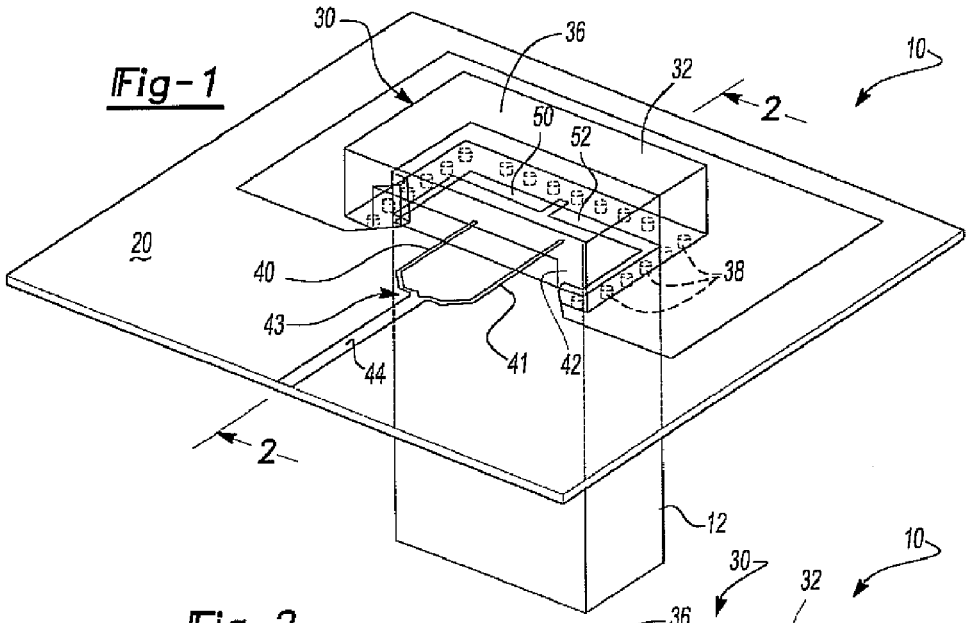
Fig-2
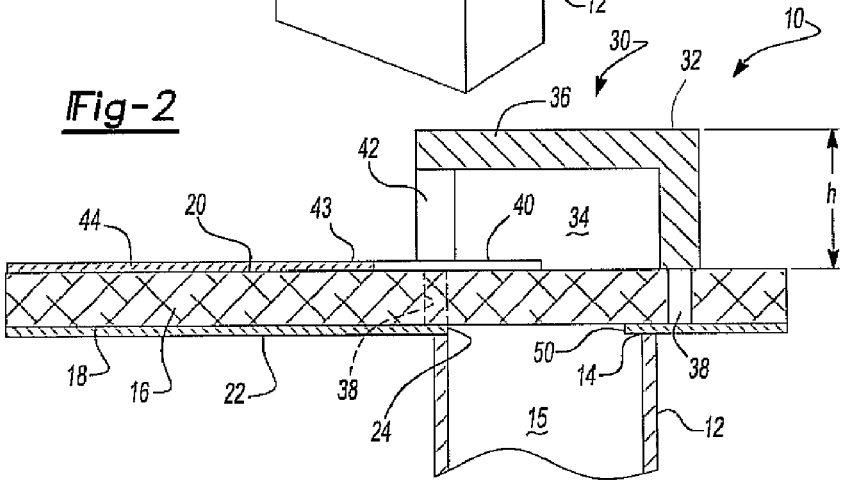
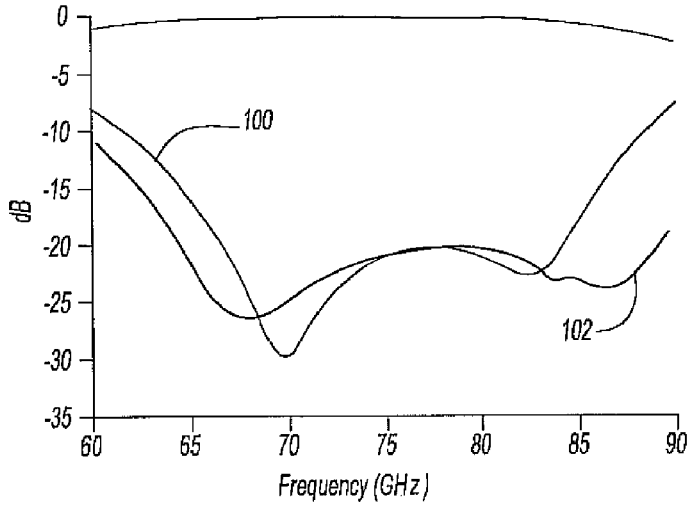
Fig-3

Fig-6
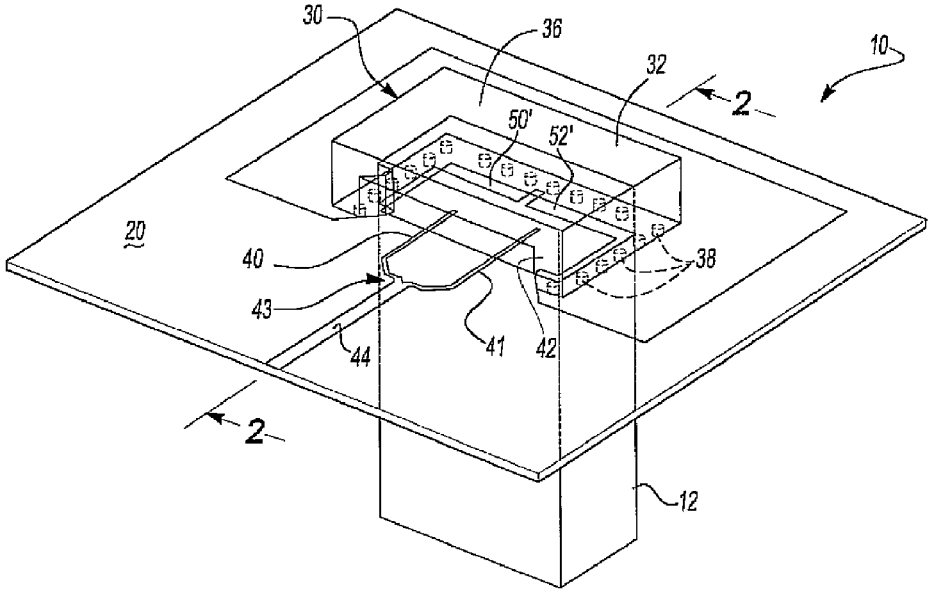
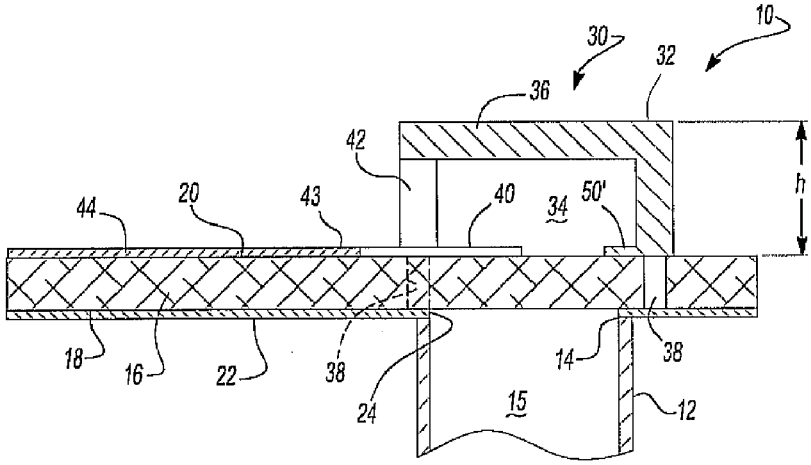
Fig-7

WAVEGUIDE TO PLURAL MICROSTRIP TRANSITION

BACKGROUND OF THE INVENTION

I. Field of the Invention

The present invention relates generally to waveguide to microstrip transitions of high frequency electromagnetic radiation.

II. Description of Related Art

The use of high frequency radio devices has become increasingly popular. For example, automotive radar has been allotted a frequency band at approximately 77 gigahertz.

The propagation of electromagnetic radiation at such high frequencies, however, has always presented special problems to microwave engineers. Conventional electronic circuitry cannot normally be used to propagate such high frequency signals due to the inherent capacitance and inductance present in such conventional electronic circuitry. Such capacitance and inductance usually results in unacceptable attenuation of the microwave signal.

Consequently, waveguides and microstrips are conventionally used to propagate high frequency radio signals in electronic circuits. In a waveguide, an elongated channel is formed by an electrically conductive material so that the high frequency signal travels through the interior of the conductor. Such waveguides are highly efficient for conducting high frequency signals along relatively long distances. Waveguides, however, cannot generally be used to directly drive a microwave antenna.

Microstrips are also utilized to propagate microwave energy. Such microstrips include a conductive strip on one side of a dielectric substrate and a ground plane on the opposite side of the dielectric substrate. The microwave energy is conveyed along the microstrip in between the microstrip and the ground plane Such microstrips may be directly connected to a microwave antenna to drive the antenna.

Consequently, in many applications, such as automotive radar, vehicle to satellite radio links, vehicle to base station radio links, etc., it is necessary to transition microwave energy from a waveguide to a microstrip. Such devices are known as waveguide to microstrip transitions.

There have been previously known waveguide to microstrip transitions which propagate the microwave energy from the waveguide to the microstrips. These previously known transitions typically include a dielectric substrate having a ground plane on one side and a microstrip on its opposite side. The dielectric substrate is positioned across an open end of the microwave guide so that an opening in the ground plane registers with the open end of the waveguide.

A back short is then positioned on the side of the dielectric substrate opposite from the ground plane so that the back short forms a cavity which registers with the open end of the waveguide as well as the opening formed through the ground plane. An end of the microstrip is then positioned through an opening in the back short so that the free end of the microstrip is positioned within the cavity formed by the back short.

In operation, the microwave energy from the waveguide propagates through the dielectric substrate and into the back short cavity. That electromagnetic energy then propagates out through the microstrip to another portion of the circuitry, typically a microwave antenna. These previously known waveguide to microstrip transitions, however, have all suffered from certain disadvantages.

One disadvantage of the previously known waveguide to microstrip transitions is that the microstrip must be precisely positioned within the back short cavity for proper impedance matching. Otherwise, an impedance mismatch results which in turn results in a loss of power in the waveguide to microstrip transition. However, in many manufacturing situations, such precision is difficult to obtain with consistency.

A still further disadvantage of these previously known waveguide to microstrip transitions is that they have limited bandwidth and increased return loss. Such limited bandwidth and increased return loss resulted from the resonant nature of the single microstrip probe and its location within the back short cavity.

SUMMARY OF THE PRESENT INVENTION

The present invention provides a waveguide to microstrip transition which overcomes the above-mentioned disadvantages of the previously known devices.

In brief, the waveguide to microstrip transition of the present invention comprises a waveguide having an opening at one end. In the conventional fashion, microwave energy at high frequency, e.g. 77 gigahertz and above, propagates through the interior of the waveguide in the conventional fashion.

A dielectric substrate includes a first and a second side. A ground plane is formed on the first side of the substrate and this ground plane also has an opening.

The dielectric substrate overlies the waveguide opening so that the ground plane faces the waveguide and so that the opening in the ground plane registers with the waveguide opening. Consequently, microwave radiation propagating through the waveguide passes through the dielectric substrate and to the second side of the dielectric substrate.

A back short has a housing which is positioned on the second side of the dielectric substrate. This back short housing forms a cavity which registers with at least a portion of the ground plane opening. This back short also includes at least one opening to the cavity along the second side of the dielectric substrate.

A pair of spaced apart microstrips are then provided on the second side of the dielectric substrate, i.e. the side opposite from the waveguide. Each microstrip has a free end positioned in the cavity formed by the back short so that the free ends of the microstrips are spaced apart from each other. Each microstrip also extends through the opening formed in the back short.

Both microstrips may extend outwardly from the back short cavity along the same side of the opening. In this case, the signals conveyed by the microstrips will be in phase with each other.

Conversely, the microstrips may extend outwardly from the back short cavity in opposite directions. In this case, the phase of the signal on the two microstrips will be inverted 180 degrees. Connection of the microstrips to a microwave antenna results in a circularly polarized signal radiated from the antenna.

BRIEF DESCRIPTION OF THE DRAWING

A better understanding of the present invention will be had upon reference to the following description when read in conjunction with the drawing wherein like reference characters refer to like parts throughout the several views, and in which:

FIG. 1 is an elevational view of a preferred embodiment of the invention;

FIG. 2 is a sectional view taken along line 2-2 in FIG. 1 and enlarged for clarity;

FIG. 3 is a graph illustrating the operation of the present invention;

FIG. 6 is a view similar to FIG. 1, but showing a modification; and

FIG. 7 is a view similar to FIG. 2, but showing a modification.

DETAILED DESCRIPTION OF PREFERRED EMBODIMENTS OF THE PRESENT INVENTION

Figure 4:
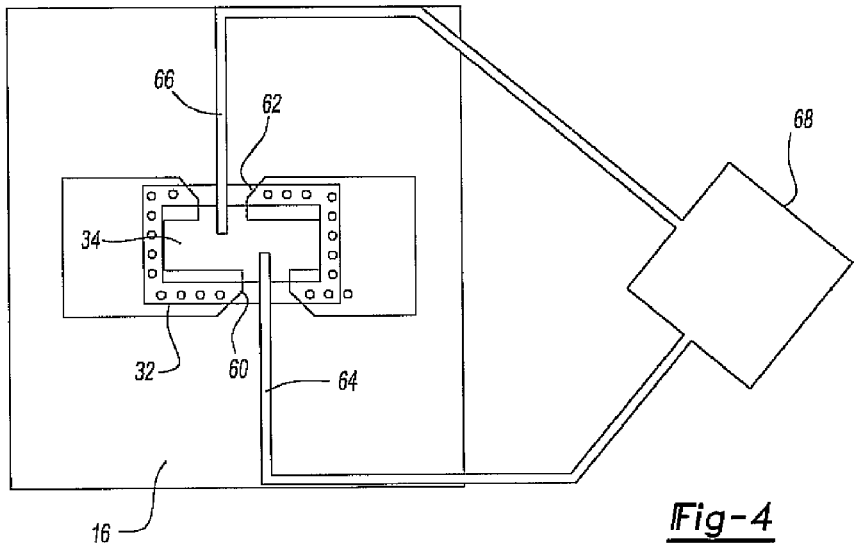
FIG. 4 is a top view illustrating a second preferred embodiment of the invention.

With reference first to FIGS. 1 and 2, a first preferred embodiment of a waveguide to microstrip transition 10 is illustrated. The transition 10 includes a waveguide 12 having an opening 14 (FIG. 2) at one end. The waveguide 12 typically defines a rectangular channel 15 (FIG. 2) throughout its interior although other shapes may be used to conduct the microwave energy through the interior of the waveguide 12.

As best shown in FIG. 2, a dielectric substrate 16 includes a first side 18 and a second side 20. The dielectric substrate 18 is constructed of any suitable dielectric material, such as liquid crystal polymer, Teflon (polytetrafluoroethylene) or the like.

A ground plane 22 made of an electrically conductive material covers the first side 18 of the dielectric substrate 16. This ground plane 22, furthermore, includes an opening 24. The dielectric substrate 18 is positioned across the waveguide opening 14 so that the ground plane 22 faces the waveguide 12 and so that the opening 24 formed in the ground plane registers with at least a portion of the waveguide opening 14. Consequently, electromagnetic energy propagated through the waveguide 12 will pass through the ground plane opening 24 and dielectric substrate 18 to the second side 20 of the dielectric substrate 16.

With reference now particularly to FIGS. 1 and 2, a back short 30 made of an electrically conductive material is positioned on the second side 20 of the dielectric substrate 16. The back short 30 includes a housing 32 having sides and a top 36 which defines an interior cavity 34 (FIG. 2). In a conventional fashion, the back short housing 32 has a thickness or height "h" equal to the resonant wavelength divided by four as shown in FIG. 2.

The back short housing 32 is positioned on the second side 20 of the dielectric substrate 16 so that the cavity 34 registers with at least a portion of the open end 14 of the waveguide 12. The back short housing 32, furthermore, is electrically grounded to the ground plane 22 by a plurality of vias 38 extending through the dielectric substrate 16 between the back short housing 32 and the ground plane 22.

Still referring to FIGS. 1 and 2, a pair of spaced apart microstrips 40 and 41 (FIG. 1) on the second side 20 of the dielectric substrate 16 each have a free end symmetrically positioned about a centerline of the cavity 34 and within the back short housing cavity 34. The microstrips 40 and 41 extend outwardly through the same side of the back short housing 32 through an opening 42 in the back short housing 32. Optionally, the microstrips 40 and 41 are joined together through a T junction 43 into a single microstrip 44 outside the back short housing 32. This combined microstrip 44 may then be connected, for example, to a microwave antenna.

A first metal portion 50, which may be either part of the ground plane 22 or of the back short housing 32 as shown at 50' in FIGS. 6 and 7, protrudes inwardly from the waveguide opening 14 in alignment with one of the microstrips 40. Similarly, a second metal portion 52 as a part of the ground plane or portion 52' of the back short housing 32 (FIG. 6) protrudes inwardly from the microwave guide opening 14 adjacent the other microstrip 40. The conductive portions 50 and 52 effectively act as capacitors to improve the overall impedance matching of the waveguide to microstrip transition 10.

A characteristic impedance of the waveguide 12 is approximately 350 ohms at the center of the waveguide opening 14. The impedance of the signal through the waveguide 12, however, diminishes from the center of the waveguide opening 14 and toward the sides of the waveguide 12.

Consequently, the microstrips 40 and 41 are preferably dimensioned for an impedance of approximately 100 ohms and are positioned away from the centerline of the waveguide 12 to a position of approximately 100 ohms for the waveguide 12. The two microstrips 40 are then connected together in parallel into the single microstrip 44. In doing so, the overall impedance is reduced by half to approximately 50 ohms which is the desired impedance for many microwave antennas.

In practice, it has been found that, due to the relatively low impedance of 100 ohms for the microstrips 40 and 41 as opposed to 350 ohms for the previously known transitions using a single microstrip in the back short 30, misalignment of the microstrips 40 and 41 has a lesser adverse impact on the impedance matching of the waveguide to microstrip transition than a similar misalignment of a single microstrip in the previously known waveguide to microstrip transitions.

With reference now to FIG. 3, a waveguide to microstrip transition graph is shown as a function of frequency in GHz versus attenuation in decibels (dB) at graph 100 for the previously known waveguide to microstrip transitions utilizing only a single microstrip. Conversely, graph 102 is a graph illustrating the transmission of microwave energy through the waveguide to microstrip transition as a function of frequency. Consequently, it can be seen that the present invention achieves greater bandwidths with lower signal loss at the edges of the bandwidth.

Figure 5:
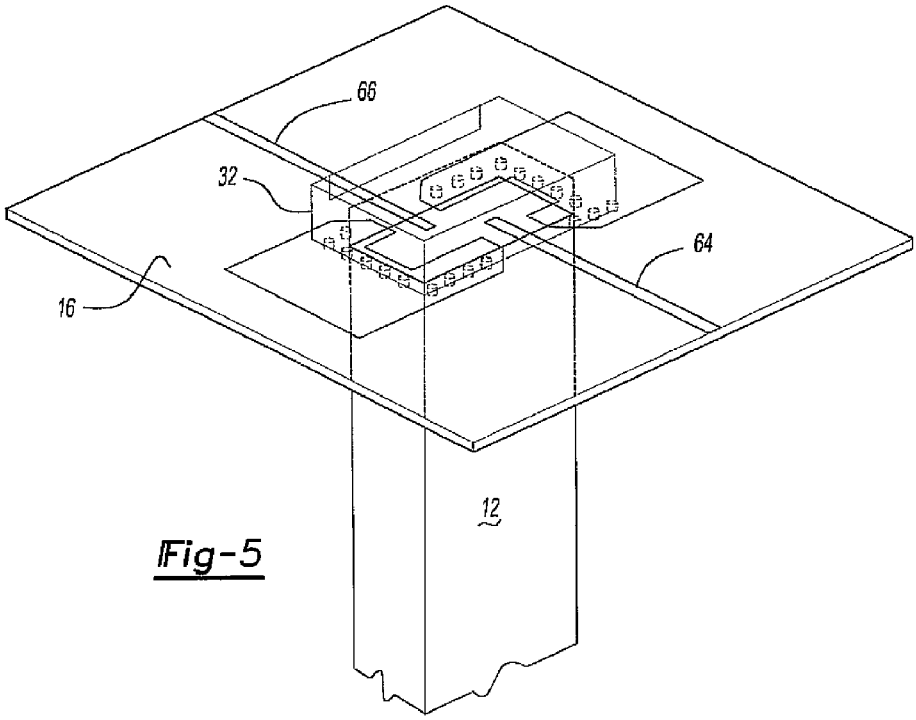
FIG. 5 is an elevational view of the second preferred embodiment of the invention.

With reference now to FIGS. 4 and 5, a modification of the present invention is shown in which the back short housing 32 includes two openings 60 and 62 on opposite sides of the back short housing 32 as shown in FIG. 4. One microstrip 64 extends through the opening 60 and has its free end positioned within the back short cavity 34 while a second microstrip 66 has its free end positioned within the cavity 34 and extends out through the opening 62 at the opposite side of the back short housing 32. The microstrips 64 and 66, however, are symmetrically positioned on opposite sides of the centerline of the cavity 34.

Since the microstrips 64 and 66 extend outwardly from opposite sides of the back short housing 32, the phase of the signal on the microstrips 64 and 66 are 180 degrees apart from each other. Consequently, by connecting the microstrips 64 and 66 to the middle of adjacent sides of a rectangular antenna 68 (FIG. 4), circular polarization of the antenna 68 is automatically realized.

From the foregoing, it can be seen that the present invention obtains not only a greater bandwidth, but also simpler impedance matching and impedance matching that is less adversely affected due to small misalignments than the previously known waveguide to microstrip transitions. Having described my invention, however, many modifications thereto will become apparent to those skilled in the art to which it pertains without deviation from the spirit of the invention as defined by the scope of the appended claims.

We claim:

1. A waveguide to microstrip transition comprising:

a waveguide having an opening at one end, a dielectric substrate having a first and a second side and a ground plane on said first side of said substrate, said ground plane having an opening, said dielectric substrate overlying said waveguide opening so that said ground plane faces said waveguide and said ground plane opening registers with said waveguide opening, a back short having a housing positioned on said second side of said dielectric substrate, said back short housing forming a cavity which registers with at least a portion of said ground plane opening, said back short having at least one opening to said cavity along said second side of said dielectric substrate, a pair of spaced apart microstrips on said second side of said dielectric substrate, each microstrip having a free end positioned in said cavity so that said free ends of said microstrips are spaced apart from each other, each microstrip extending through said at least one back short opening, wherein at least one portion of said back short housing is spaced inwardly from said waveguide opening.

2. The waveguide to microstrip transition of claim 1 wherein said microstrip ends are linear and spaced apart and parallel to each other.

3. The waveguide to microstrip transition of claim 2 wherein said microstrip ends are symmetrically positioned in said cavity around a centerline of said cavity.

4. The waveguide to microstrip transition of claim 1 wherein said microstrips extend outwardly from opposite sides of said cavity.

5. The waveguide to microstrip transition of claim 4 wherein each microstrip is connected to spaced positions of a microwave radiator.

6. The waveguide to microstrip transition of claim 1 wherein said back short housing is electrically connected to said ground plane by a plurality of spaced apart vias extending through said dielectric substrate.

7. The waveguide to microstrip transition of claim 1 wherein said microstrips extend outwardly from a same side of said cavity.

8. The waveguide to microstrip transition of claim 7 wherein said microstrips are joined together into a single microstrip on said second side of said dielectric substrate outside said cavity.

9. The waveguide to microstrip transition of claim 1 wherein said at least one portion of said back short housing spaced inwardly from said waveguide opening comprises two portions of said back short housing spaced inwardly from said waveguide opening, one of said two portions associated with said free end of one microstrip and the other of said two portions associated with said free end of the other microstrip.

* * * * *